United States Patent [19]

Stelzer

[11] 4,385,597

[45] May 31, 1983

[54] TWO-STROKE INTERNAL COMBUSTION ENGINE

[76] Inventor: Frank Stelzer, Elbestrasse 39, Raunheim, Fed. Rep. of Germany

[21] Appl. No.: 285,495

[22] Filed: Jul. 21, 1981

[30] Foreign Application Priority Data

Aug. 1, 1980 [DE] Fed. Rep. of Germany ..... 3029287

[51] Int. Cl.[3] ..... F02B 33/06

[52] U.S. Cl. ..... 123/62; 123/46 A

[58] Field of Search ..... 123/62, 61 V, 61 R, 123/56 B, 56 BC, 71 V, 65 W, 65 PE, 46 R, 46 A

[56] References Cited

U.S. PATENT DOCUMENTS

| | | | |
|---|---|---|---|
| 567,530 | 9/1896 | Willetts | 123/62 |
| 1,040,472 | 10/1912 | Wade | 123/62 |
| 1,215,383 | 2/1917 | Kenyon | 123/62 |
| 2,115,180 | 4/1938 | Schneider | 123/65 W |
| 2,337,668 | 12/1943 | Larson | 123/65 W |
| 2,918,045 | 12/1959 | Brown | 123/71 V |

*Primary Examiner*—Wendell E. Burns

*Attorney, Agent, or Firm*—Dennison, Meserole, Pollack & Scheiner

[57] ABSTRACT

A two-stroke combustion engine is described which has a symmetrical, floating differential piston (14), having at least two main piston portions (16, 18), each movable in a combustion chamber (28, 30) formed with exhaust ports (46), and each connected to a pre-compression chamber (34, 36) by means of a respective channel (38, 40). The combustion chambers (28, 30) are arranged axially inward of the piston portions and between the chambers lies the pre-compression chamber (32) in which a central double-acting piston portion (22) of the differential piston (14) is arranged on a piston rod (20). The central piston portion (22) divides the pre-compression chamber (32) into two separate supercharging chambers (34, 36), from which the channels (38, 40) leading to the combustion chambers (28, 30) terminate at the end walls of the respective combustion chambers. Valve means (24, 26) on the piston rod (20) serve to open and close the channels so that upon expansion occurring in one combustion chamber material exchange will occur in the other.

5 Claims, 1 Drawing Figure

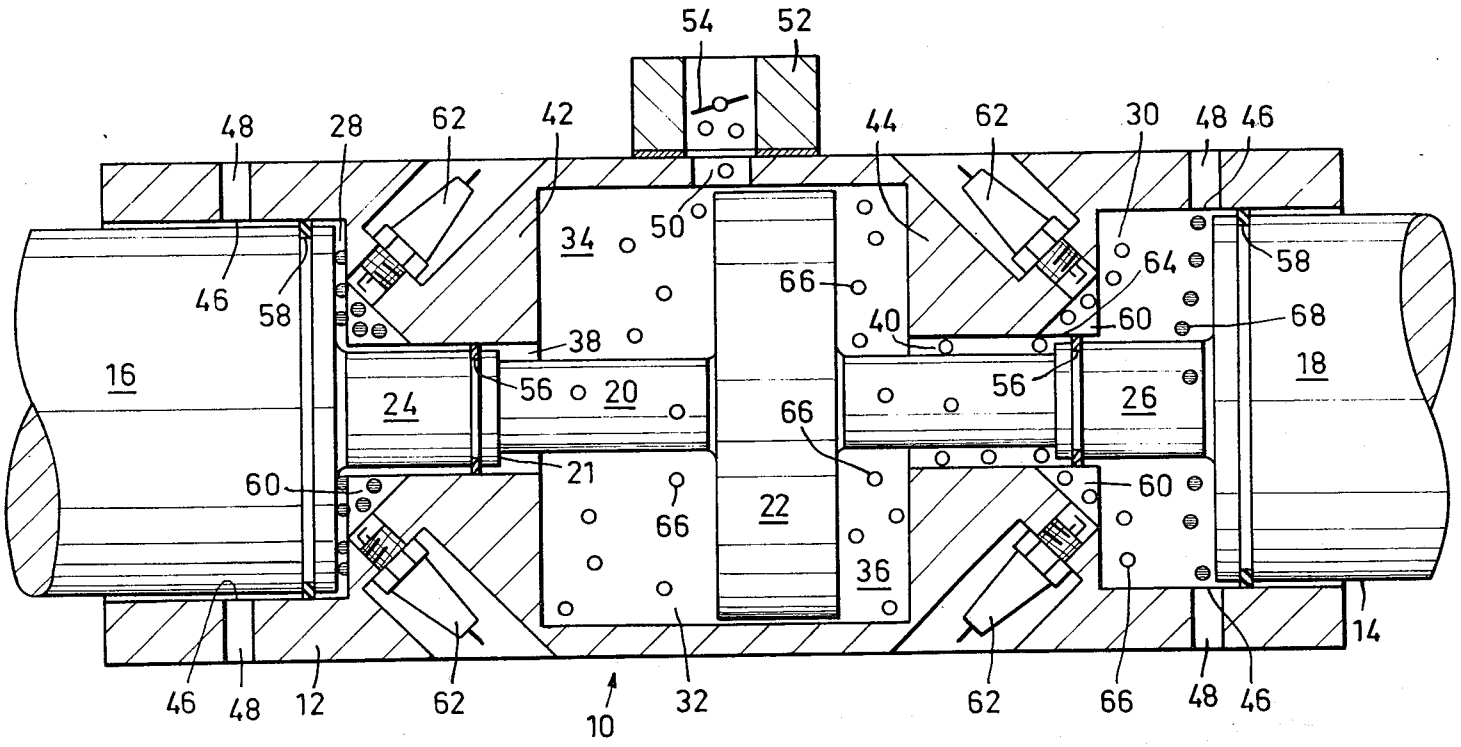
14
18
58
68
46
48
30
64
60
26
66
62
56
44
40
36
52
22
54
50
32
20
34
38
21
10
42
24
28
12
16

TWO-STROKE INTERNAL COMBUSTION ENGINE

This invention relates to a two-stroke internal combustion engine with a symmetrical, floating differential piston having at least two piston portions, each of which is movable in a respective combustion chamber each of which is provided with exhaust slots, and each of which can be brought into communication with a pre-compression chamber by means of a channel.

Such a combustion engine has been described in German Offenlegungsschrift No. 14 51 662. In this combustion engine there are two separate pre-compression chambers axially inward of the piston portions, while the combustion chambers for the piston portions are arranged axially outward of the combustion chambers; one combustion chamber and one pre-compression chamber each being located in a common hollow cylinder in which the piston portion is movable. Between the pre-compression chambers and the combustion chambers there are overflow channels ending in the cylinder wall.

It is an object of the invention to improve the material exchange process in such an internal combustion engine.

According to the present invention there is provided a two-stroke internal combustion engine, comprising a cylinder, a symmetrical, differential piston freely movable within the cylinder, and having two spaced main piston portions each movable in a respective combustion chamber, the combustion chambers being arranged axially inwardly of the respective piston portions, an axially extending piston rod connecting said main piston portions, a pre-compression chamber arranged between said combustion chambers, a central, double-acting piston portion on said piston rod movable in said pre-compression chamber and dividing the same into two separate compression chambers, channels connecting the pre-compression chamber with each combustion chamber, and valve means on said piston rod for closing the channel leading to one combustion chamber and for opening the channel leading to the other combustion chamber, whereby upon expansion occurring in said one combustion chamber material exchange occurs in the other. The pre-compression chamber and the central piston portion in this arrangement, with respect to their diameters, are independent of the diameters of the combustion chambers. Consequently, the dimensions of the chamber can be optimally adapted to the compression load necessary for overcoming the back-pressure of the exhaust. A further advantage is the scavenging determined by the arrangement of the ports and channels whereby almost the entire cylinder space is swept by the scavenging flow. Since this arrangement does not have any scavenging ports, a larger surface at the cylinder circumference is available for the exhaust ports. Therefore exhaust ports of small axial dimensions and large radial dimensions can be employed, thus resulting in an increase of effective piston stroke.

The above described arrangement can be constructed as a compressor, with the two main piston portions simultaneously used as working pistons. Graduations of the pistons are no longer required. Such a combined power and work machine is of simple design permitting a relatively low-priced manufacture.

In a preferred embodiment, the channels between the pre-compression chambers and the combustion chambers are of hollow-cylindrical configuration and arranged concentrically around the piston rod. The advantage of this arrangement lies in the improved scavenging which can be obtained in the combustion chambers.

In a preferred embodiment, the valves are each formed by a respective piston portion on the piston rod and each adapted to the cross-section of the channels, so that in the lower dead centre position of the respective piston portion an opening exists between the annular front face of the piston portion and the wall of the channel for the scavenging flow. With this arrangement, the exchange of material can be controlled by means of a simple piston valve construction.

Preferably piston rings are mounted on the cylindrical outer walls of the piston portions close to their annular front faces.

Openings preferably exist between the front face of the respective combustion chamber and the wall section adjacent to the front face of the channel starting from the pre-compression chamber, which openings are uncovered in the lower dead centre position of the piston portion by the piston valve contacting the wall zones not formed with openings. The advantage of this arrangement lies in the inevitable guidance through the channel walls along the total stroke length of the piston valve.

Preferably a suction opening is formed in the cylindrical wall of the further chamber centrally between the two end faces, and this suction opening may communicate with either of the two pre-compression chambers, depending upon the position of the central piston portion, the respective pre-compression chamber being either in communication with the exhaust opening or sealed against it.

The exhaust channels may end in the combustion chambers in exhaust slots and lead into the chamber in an essentially tangential manner; with this arrangement a longitudinal scavenging is effected.

In order to enable the invention to be more readily understood, reference will now be made to the accompanying drawing, which illustrates diagrammatically and by way of example an embodiment thereof, and which is a longitudinal section through a two-stroke internal combustion engine in accordance with the invention.

Referring now to the drawing, there is shown a cylinder 10 having a wall 12, and containing a floating differential piston 14 which is freely movable in its axial direction.

The differential piston 14 comprises two main piston portions 16 and 18 joined by a piston rod 20 on which is mounted a central double-acting piston portion 22 and two valve piston portions 24 and 26 of reduced diameter as compared with the piston portions 16, 18 and 22, the piston portions 16 and 18 having the same diameter. The piston rod 20 has a diameter which is considerably smaller than the diameter of the piston portions 16 and 18, while the diameter of the central double-acting piston portion 22, can be the same as the diameter as the piston portions 16 and 18 or, as shown, can be greater. The two valve piston portions 24 and 26 have equal diameters which are somewhat larger than the diameter of the piston rod 20 and have annular front faces 21.

The cylinder 10 is formed with two combustion chambers 28 and 30, each arranged axially inward of the respective piston portions 16 and 18. A further chamber 32 is located between the two combustion chambers 28 and 30. The central piston portion 22 is movably arranged in this further chamber 32. The central piston portion 22, forming a unit with the piston rod 20, divides the further chamber 32 into two pre-compression chambers 34 and 36, each being connected with a respective combustion chamber 28 or 30 via a channel 38 or 40. The further chamber 32 is arranged centrally between the two combustion chambers 16 and 18 and is separated therefrom by a wall 42 or 44 respectively. Channels 38 and 40 of hollow-cylindrical configuration are formed in the walls 42 and 44. The cylindrical walls (not described in any more detail) of the channels 38 and 40 each concentrically surround a portion of the piston rod 20. Between the cylindrical outer wall of the piston rod 20 and the cylindrical inner wall of the respective channel 38 or 40 there is a free space, into which a gaseous medium can flow from the respective pre-compression chamber 34 or 36 to the adjacent combustion chamber 28 or 30, in which, during one stroke of the piston due to combustion of a gas-air-mixture, the piston portion 16 or 18 respectively moves whereby heat energy is transformed into mechanical work.

The combustion chambers 28 and 30 are each in communication with exhaust ports 46 arranged in front of the lower dead centre position of the respective piston portion 16 or 18. Exhaust channels 48 are formed in the cylinder wall 12 adjacent to the exhaust ports 46. In the internal combustion engine shown in the drawing, the exhaust channels run normal to a plane containing the longitudinal axis of the differential piston 14. However, the exhaust channels 48 could extend transverse to the longitudinal axis, so that their axes intersected the axes of the piston portions 24 and 26 and the piston rod 20. Alternatively, the channels 48 could lead tangentially or almost tangentially from the combustion chambers 28 and 30. With this arrangement, it is possible to achieve a favourable longitudinal scavenging of the combustion chambers 28 and 30 in combination with the exhaust openings of the channels 38 and 40 in the front or inner faces of the combustion chambers 28 and 30.

The additional chamber 32 has a suction opening 50 leading through the cylinder wall 12 centrally between the two end walls of the chamber 32. Upstream of the suction opening 50, which is of e.g. cylindrical configuration, there is a carburettor 52 adjacent to the cylinder 10, if the combustion engine is designed to work on the Otto cycle. In the drawing, only a portion of the carburettor 52 having a throttlevalve 54 is shown.

The diameters of the portions 24 and 26 are adapted to the cross-sections of the channels 38 and 40, the diameters being chosen such that the portions 24 and 26 will seal the channels 38 and 40 as tightly as possible, while still permitting axial movement of the portions 24 and 26 in the channels 38 and 40. The portions 24 and 26 each project from the front faces of the piston portions 16 and 18 respectively. The length of the portions 24 and 26 depends upon the lower dead center position of the piston portions 16 and 18. In the lower dead center position of the piston portion 16 or 18, the respective portion 24 or 26 should uncover the associated channel 38 or 40 to enable gaseous medium to be supplied to the combustion chamber 28 or 30. On the compression stroke of the piston portion 16 or 18 the respective portion 24 or 26, after closing the appropriate exhaust port 46, will seal the respective channel 38 or 40. Sealing is preferably effected by piston rings 56 arranged on the cylindrical walls of the portions 24, 26 close to their annular front faces 21. The piston portions 16 and 18 are likewise equipped with piston rings 58.

Openings 60 of triangular section are formed between the front faces of the combustion chambers 28 and 30 and the cylindrical outer walls of the channels 38 and 40, the openings 60 being arranged in pairs opposite to each other and defining chambers widening toward the combustion chambers 28 and 30. If the internal combustion engine is designed as an Otto engine, the ends of spark plugs 62 can project into the openings 60.

In the lower dead center position of the respective piston portion 16 or 18 the appropriate piston ring 56 still contacts the wall existing between the openings 60 of the respective channel 38 or 40. The gaseous medium flows through an opening 65 located in the cylindrical channel wall into the opening 60 and from there into the respective combustion chamber 28 or 30. The portions 24 and 26 are of such a length that the contact between the piston rings 56 and the walls of the channels 38 and 40 will not be interrupted even in the lower dead center positions of the piston portions 16 and 18, whereby a good guidance of the portions 24 and 26, which form the piston valves, is obtained with respect to the openings of the channels 38 and 40.

In the drawing the piston portions 16 and 18 are only partially shown. The ends of the piston portions 16 and 18 remote from the combustion chambers 28 and 30 can be arranged in chambers of working machines (not shown here). Thus, the cross-section does not have to be reduced, i.e. for the working machines the same piston stroke will be available for the same cylinder cross-section. The combustion chambers 28 and 30 and the working machine chambers can have a common cylinder space of the same diameter. Such an arrangement can be relatively inexpensive.

In the drawing the exhaust gas is symbolically represented by small, full black circles 68. The gaseous medium being supplied to the combustion chambers is represented by small circles 66 with black outlines.

The internal combustion engine operates as follows: As shown in the drawing, piston portion 16 in the left hand combustion chamber 28 is in the compression position at its reversing point when the gaseous medium is ignited. Thereby combustion gases 68 are generated. The right hand piston portion 18 has reached its lower dead center position in which the exhaust ports 46 are open. The channel 40 is in communication with the combustion chamber 30. The central piston portion 22 is on the right hand side of the chamber 32 and has compressed the gaseous medium 66 to a pressure which is higher than the exhaust back-pressure. By adequately selecting the size of the chamber 32 and the diameter of the central piston portion 22, the pressure in the pre-compression chamber 36 can be set to a value which is especially favourable for effecting scavenging. The scavenging process practically ends in the combustion chamber 30. The arrangement of the channels 38 and 40 is such that the entire combustion chamber will be extensively swept during the savenging process. In the pre-compression chamber 34 a gaseous medium 66 has been sucked in through the opening 50. The precompression chamber 34, at the position of the central piston portion 22 shown in the drawing, has reached its maximum volume while the pre-compression chamber 36 is at its lowest volume. Due to the fact that in the sidewalls of the combustion chambers 28 and 30 there are only exhaust slots of which the dimensions in the axial direction of the differential piston 14 can be kept rather small, there will be a small loss of stroke only. Therefore, this arrangement has a very effective piston stroke.

After combustion of the gaseous medium the piston portion 16 is forced to the left, the central piston portion 22 and the piston portion 18 following this movement, whereby the piston portion 22 seals the opening 50 and subsequently compresses the gaseous medium 66 in the pre-compression chamber 34. The piston portion 18 covers the exhaust ports 46, while the portion 26 seals the openings 64. Thereafter the gaseous medium is compressed in the combustion chamber 30. The piston portion 22 will uncover the opening 50 so that gaseous medium is sucked in to the pre-compression chamber 36. As the piston portion 16 uncovers the exhaust ports 46, the expansion of the exhaust gases 68 is interrupted. There will be a sudden fall of pressure in the combustion chamber 28 due to the back-pressure behind the channels 48. As soon as this back-pressure is dominant in the combustion chamber 28, the portion 24 moves to establish communication between the combustion chamber 28 and the pre-compression chamber 34. Then a scavenging process takes place during which gaseous medium 66 replaces the exhaust gases 68 in the combustion chamber 28. In the meantime the gaseous medium is compressed in the combustion chamber 30 to ignition. After termination of this stroke, the sequence of operations is repeated vice versa.

The power generated by the combustion can be transformed into work by the piston portions 16 and 18, in that, for example, in further chambers (not shown) still another medium can be periodically sucked in and exhausted. This medium can then drive other working machines, for example, turbines, in a further cycle (not shown).

I claim:

1. A two-stroke internal combustion engine, comprising a cylinder having a pair of combustion chambers, a symmetrical, free floating differential piston freely movable within the cylinder, and having two spaced main piston portions each movable in a respective combustion chamber, the combustion chambers being arranged axially inwardly of the respective piston portions and each having exhaust means, an axially extending piston rod connecting said main piston portions, a pre-compression chamber arranged between said combustion chambers, a central, double-acting piston portion on said piston rod movable in said pre-compression chamber and dividing the same into two separate compression chambers, channels of hollow cylindrical configuration connecting the pre-compression chamber with each combustion chamber, said channels being located about said piston rod, and piston type valve means formed on said piston rod for closing the channel leading from one compression chamber to one combustion chamber and for opening the channel leading to the other combustion chamber when its main piston portion is in its bottom dead center position, whereby upon expansion occurring in said one combustion chamber material exchange occurs in the other, and a fuel mixture inlet port communicating with said pre-compression chamber, said double-acting piston portion adapted to close said inlet port and to alternately allow fuel mixture inlet into the separate compression chambers.

2. A two-stroke engine as defined in claim 1, wherein the piston type valve means each comprise a cylindrical piston portion formed integrally on said piston rod and having a diameter adapted to slidingly engage within the cylindrical channels, and further including an opening for scavenging flow of the fuel mixture which is uncovered by the valve piston portion when its respective main piston portion is in its lower dead center position.

3. A two-stroke engine as claimed in claim 2, wherein piston rings are provided on the cylindrical outer walls of the valve piston portions close to the annular front faces thereof.

4. A two-stroke engine as claimed in claim 1, wherein exhaust channels terminating in exhaust ports lead essentially tangentially into each combustion chamber.

5. A two-stroke engine as claimed in claim 1, wherein the main piston portions have the same diameter both in the combustion chambers and in associated working chambers.

* * * * *